US009542807B2

(12) United States Patent
Anderson et al.

(10) Patent No.: US 9,542,807 B2
(45) Date of Patent: Jan. 10, 2017

(54) CONTROLLING EVENT-DRIVEN BEHAVIOR OF WAGERING GAME OBJECTS

(71) Applicant: Bally Gaming, Inc., Las Vegas, NV (US)

(72) Inventors: Peter R. Anderson, Glenview, IL (US); Robby M. Friedman, Round Lake, IL (US); Mark B. Gagner, West Chicago, IL (US); Timothy T. Gronkowski, Chicago, IL (US); Michael J. Irby, II, Chicago, IL (US); Victor T. Shi, Morton Grove, IL (US); John L. Walsh, Gurnee, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/277,989

(22) Filed: May 15, 2014

(65) Prior Publication Data

US 2014/0248934 A1 Sep. 4, 2014

Related U.S. Application Data

(63) Continuation of application No. 12/509,003, filed on Jul. 24, 2009, now Pat. No. 8,758,125.

(51) Int. Cl.
*A63F 9/24* (2006.01)
*G07F 17/32* (2006.01)

(52) U.S. Cl.
CPC ..... *G07F 17/326* (2013.01); *G07F 17/32* (2013.01); *G07F 17/3232* (2013.01)

(58) Field of Classification Search
CPC ..... G07F 17/32
See application file for complete search history.

(56) References Cited

U.S. PATENT DOCUMENTS

| | | | |
|---|---|---|---|
| 7,125,333 | B2 | 10/2006 | Brosnan |
| 2005/0049029 | A1 | 3/2005 | Gazdic et al. |
| 2009/0247254 | A1 | 10/2009 | Schlottmann et al. |
| 2011/0021263 | A1 | 1/2011 | Anderson et al. |

OTHER PUBLICATIONS

"U.S. Appl. No. 12/509,003 Office Action", Sep. 13, 2013, 9 Pages.
Aigamedev.com, "behavior-trees-part2", http://aigamedev.com/videos/behavior-trees-part2 2008_03_21 , 1-6 pages.

(Continued)

*Primary Examiner* — Omkar Deodhar
(74) *Attorney, Agent, or Firm* — DeLizio Law, PLLC

(57) ABSTRACT

A behavior controller system and its operations are described herein. In embodiments, the operations can include determining an outcome to present for a wagering game. The wagering game includes a wagering game object configured to present the outcome using a set of possible behavioral responses. The operations can further include, based on the outcome, determining priorities for the set of possible behavioral responses and performing at least a portion of the set of possible behavioral responses according to the priorities. The operations can further include; and causing the wagering game object to present the outcome for the wagering game based on the performing the at least the portion of the set of possible behavioral responses.

28 Claims, 9 Drawing Sheets

(56) References Cited

OTHER PUBLICATIONS

Aigamedev.com, "bt-overview", http://aigamedev.com/hierarchical-logic/bt-overview 2008_03_21 , 1-5 pages.
Aigamedev.com, "hierarchical-logic/decorator", http://aigamedev.com/hierarchical-logic/decorator 2008_03_21 , 1-7 pages.
Aigamedev.com, "hierarchical-logic/parallel", http://aigamedev.com/hierarchical-logic/parallel 2008_03_21 , 1-7 pages.
Aigamedev.com, "hierarchical-logic/selector", http://aigamedev.com/hierarchical-logic/selector2008_03 _21 , 1-6 pages.
Aigamedev.com, "hierarchical-logic/sequence", http://aigamedev.com/hierarchical-logic/sequence2008_03 _21 , 1-6 pages.
Aigamedev.com, "modular-behaviors/actions-conditions", http://aigamedev.com/modular-behaviors/actions-conditions2008_03_21 , 1-7 pages.
Aigamedev.com, "programming-tips/tasks", http://aigamedev.com/proqramming-tips/tasks2008_03_21_, 1-5 pages.
Champandard, Alex J. et al., "Behavior Trees for Next-Gen Game AI (Video, Part 1)", AiGameDev.com http://aigamedev.com/videos/behavior-trees-part1 (Obtained Mar. 21, 2008).
Champandard, Alex J. et al., "Behavior Trees for Next-Gen Game AI (Video, Part 1)", AiGameDev.com http://aigamedev.com/videos/behavior-trees-part-3 (Obtained Mar. 21, 2008).
Metanet Software, "N Tutorials—Broad-Phase Collision", http://www.harveycartel.org.metanet/tutorials/tutorialB.html2008_03_21 , 1-10 pages.
Metanet Software, "N Tutorials—Collision Detection and Response", http://www.harveycartel.org/metanet/tutorials/tutorialA.html2008_03_21 , 1-12 pages.

CONTROLLING EVENT-DRIVEN BEHAVIOR OF WAGERING GAME OBJECTS

RELATED APPLICATIONS

This application is a continuation application of, and claims priority benefit to, U.S. application Ser. No. 12/509,003 filed Jul. 24, 2009. The application Ser. No. 12/509,003 is incorporated herein by reference.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

TECHNICAL FIELD

Embodiments of the inventive subject matter relate generally to wagering game systems, and more particularly to devices and processes that control event-driven behavior of wagering game objects in wagering game systems and networks.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example operating environments while the fifth section describes additional example embodiments. The sixth section presents some general comments.

Introduction

This section provides an introduction to some embodiments.

Figure 1:
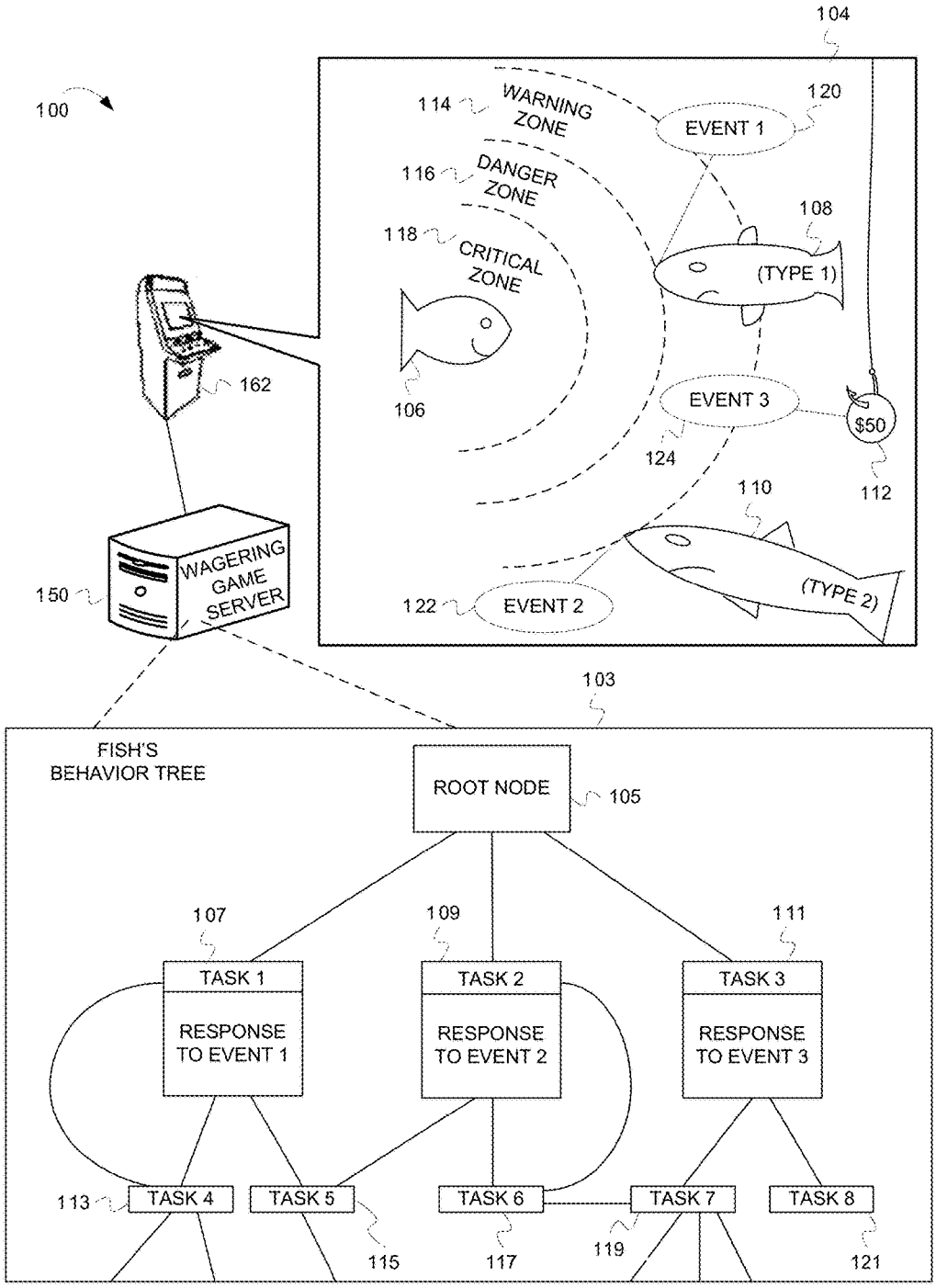
FIG. 1 is an illustration of controlling wagering game behavior using an event-driven behavior controller, according to some embodiments.

Wagering games are continuously becoming more interesting in their functionality. As a result, they are also becoming more complex. Characters and other displayed objects in wagering games have to interact with a host of other objects within the wagering game environment. This leads to increased challenges in controlling and managing the behaviors of the all the objects' movements and interactions within the wagering game. Some specific challenges include having to deal with more object interaction conflicts, more complex object functionality, more object path congestion, greater problems with object motion fluidity, etc. As a result, programmers are having to write longer and more complex programs and scripts to deal with these challenges, which requires more programming, updating, and maintenance time. FIG. 1, however, and other figures herein, illustrate examples, according to some embodiments, of using one or more event-driven, wagering-game-behavior controllers ("behavior controllers") to control behavior of wagering game objects. The behavior controller causes wagering game objects to automatically recognize and respond to different events that occur within the wagering game environment. The behavior controller can be attached to a wagering game object, thus making the wagering game object its own controller, in turn making object activity more fluid and efficient while minimizing the amount of programming needed to control interactions of separate wagering game objects. Because the behavior controller can be attached to a wagering game object, and because the behavior controller gives the object some autonomy, the behavior controller may be referred to herein as "self-managing", "object specific", "intelligent", etc.

FIG. 1 illustrates an example of controlling wagering game behavior using an event-driven behavior controller. In FIG. 1, a wagering game system ("system") 100 includes a wagering game machine 162 connected to a wagering game server 150. The wagering game machine 162 includes a game display 104 that depicts multiple wagering game objects. The wagering game objects include a player object (e.g., the fish 106), one or more non-player objects (e.g., the predators 108, 110), and a game outcome object (e.g., the coin 112). The fish 106 represents a wagering game player's character within the game display 104. The predators 108, 110, represent system generated objects (e.g., casino generated objects, server-controlled objects, non-player objects, etc.) that antagonize the fish 106 (e.g., chase it away from the coin 112, try to eat the fish 106, etc.). The system 100 generates a wagering game result that instructs the fish 106 to either eat the coin 112 (i.e., a win result), or to not eat the coin 112 (i.e., a loss result). The fish 106 can use a hierarchical type of event-driven behavior controller, according to some embodiments. In other words, the event-driven behavior controller that controls the actions of the fish 106 can have a hierarchical, or "tree" structure, as in the behavior tree 103. The behavior tree 103 includes multiple tasks 107, 109, 111, 113, 115, 117, 119, 121, that control the response of the fish 106 to events that occur within the wagering game. Some events can relate to a proximity range of the fish 106. For instance, the fish 106 may have multiple proximity ranges 114, 116, 118, invisible to the player's view, indicating distances from the fish 106. The proximity ranges 114, 116, 118, can be labeled based on the type of event that occurs. For example, if a predator fish 108, 110, enters one of the proximity ranges 114, 116, 118, the ranges may be labeled by the system 100 according to the degree of alarm invoked in the fish 106 (e.g., a warning zone 114, a danger zone 116, a critical zone 118). Specifically, a first task 107 can produce an "aggressive" response to an invasion by the predator fish 108. The predator fish 108 may be a first type of system-controlled object that possesses certain characteristics of which the behavior tree 103 is aware. As a result, the first task 107 may induce an aggressive behavior when the predator fish 108 enters the proximity range 116, or "danger zone". The task 107 may include specific instructions that cause the fish 106 to emulate a defensive ploy, such as moving toward the predator fish 108. The task 107 can also include one or more dependant, or "child" tasks 113, 115, that follow the response, or are induced by the response, indicated in task 107. For example, a child task 113 can cause the fish to become less aggressive, and move away from the predator fish 108 once the predator fish enters the proximity range 118, or the "critical zone". On the other hand, a second task 109 can include responses that the fish engages in when a second type of system-controlled object (i.e., the predator fish 110) enters a proximity range. For example, if the second predator fish 110 enters the warning zone 114, the task 109, can instruct the fish 106 to move away from the predator fish 110 slowly. A second task 109 can also have one or more child tasks (e.g., task 117), which cause the fish 106 to move away from the predator fish 110 quickly as soon as the predator fish 110 enters the danger zone 116.

The behavior tree 103 can also include tasks that cause the fish 106 to respond to wagering game goals or objectives. For instance the coin 112 can be associated with a wagering game result. The wagering game server 150 can produce the wagering game result, either for the fish 106 to eat the coin 112 or not eat the coin 112 (e.g., nearly miss the coin 112, delay long enough for another fish to eat the coin 112, run away from the predator fish 108, 110 until the coin 112 disappears, etc.). The wagering game result can be a third event 124, that the system 100 indicates to the behavior tree 103. The behavior tree 103 can have a third task 111 that includes a response to the third event 124. For instance, if the third event 124 indicates a "win", the third task 111 can include an instruction for the fish 106 to swim toward the coin 112 and eat the coin 112. However, because predator fish 108, 110 are in the path between the fish 106 and the coin 112, the behavior tree 103 also processes the first and second tasks 107, 109 according to the events caused by the predator fish 108, 110 as they pursue the fish 106 and/or as the fish 106 interacts with and evades the predator fish 108, 110. Consequently, the behavior tree 103 acts as a self-managing behavior controller, that moves up and down the tree structure of the behavior tree according to events within the wagering game and responses induced by the tasks (e.g., tasks 107, 109, 111, etc.) within the behavior tree 103. The tasks can move up levels of the tree structure as well as down levels, within the same level, as loops or repeating structures, etc. The behavior tree 103 can also include a starting place, such as a root node 105, for reference, or direction. In some embodiments, the behavior tree 103 can include specialized behavior controllers that that work within the behavior tree 103, such as schedulers, composite tasks, special tasks, conditions and actions, etc. The system 100 can work with other behavior controllers, (e.g., finite state machines, artificial neural networks, path finding layers, agents, etc.) that work external to, but in conjunction with, the behavior tree 103. In some embodiments, the system 100 can utilize a simulation of a Newtonian physics model, or "physics engine", in conjunction with behavior controllers.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
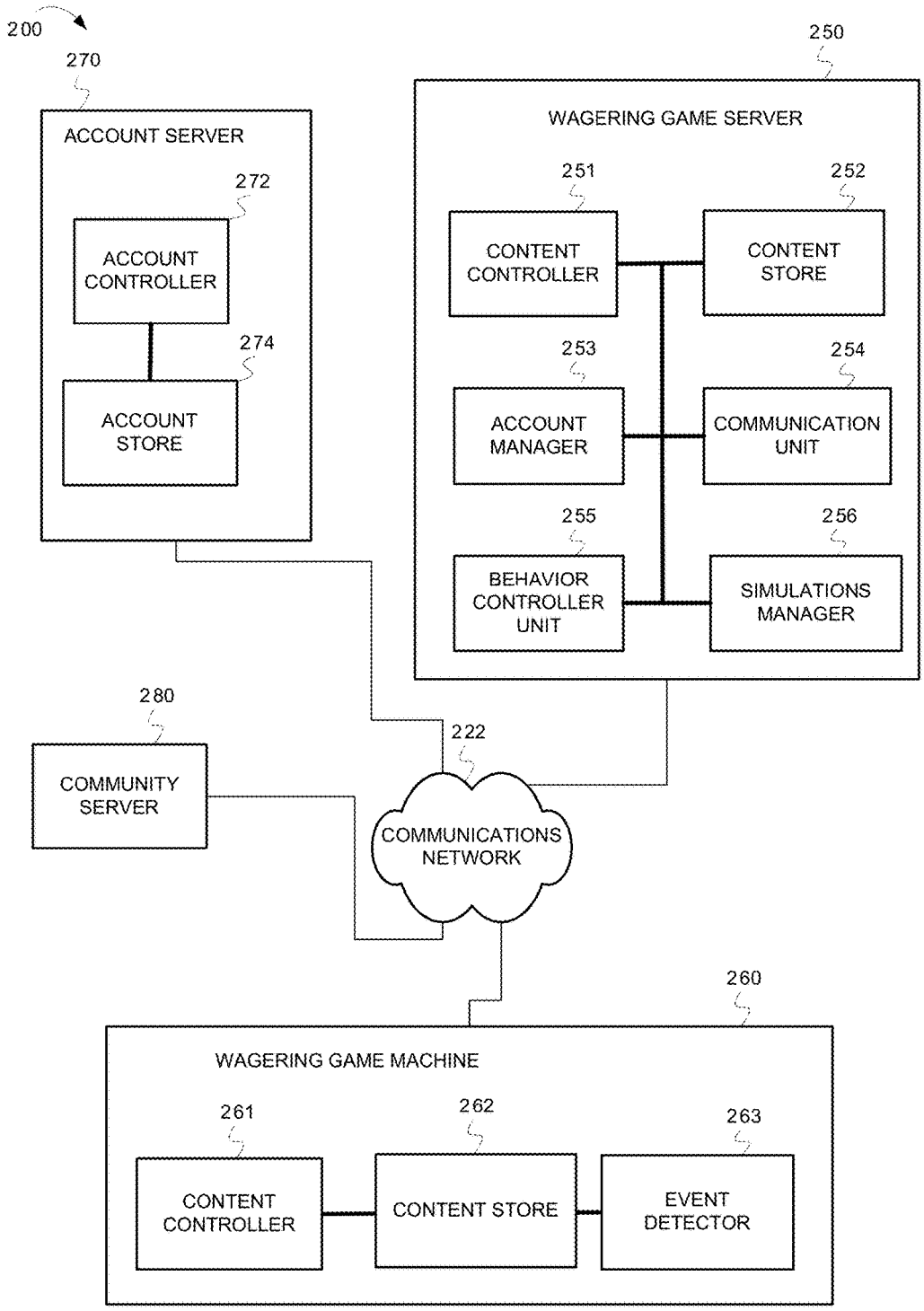
FIG. 2 is an illustration of a wagering game system architecture 200, according to some embodiments.

FIG. 2 is a conceptual diagram that illustrates an example of a wagering game system architecture 200, according to some embodiments. In FIG. 2, the wagering game system architecture 200 includes a computer 245 connected to a communications network 222. Also connected to the communications network 222 are a wagering game machine 260, a wagering game server 250, an account server 270, and a community server 280.

The wagering game system architecture 200 can include the account server 270, which can be configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 272 configured to control information for a player's account. The account server 270 also can include an account store 274 configured to store information for a player's account, such as player preferences regarding player character behaviors. The account server 270 can connect to the community server 280 via the communication network 222. A user can login to a social-network account on the community server 280 and configure user preferences regarding how a wagering game object can behave during a wagering game. The community server 234 can connect to an account on the account server 270, which can store both social-network account information and wagering game account information.

The wagering game system architecture 200 also can include the wagering game server 250 configured to control wagering game content and communicate wagering game information, account information, and behavior controller information to and from the wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 also can include a content store 252 configured to contain content to present on the wagering game machine 260. The wagering game server 250 also can include an account manager 253 configured to control information related to player accounts. For example, the account manager 253 can communicate wager amounts, game results amounts (e.g., win amounts), bonus game amounts, etc., to the account server 270. The wagering game server 250 also can include a communication unit 254 configured to communicate information to the wagering game machine 260 and to communicate with other systems, devices and networks. The wagering game server 250 also can include a behavior controller unit 255 configured to control behavior of wagering game objects within a wagering game. The behavior controller unit 255 can determine events from a wagering game and cause the wagering game objects to respond to the events. The behavior controller unit can utilize various behavior controllers assigned to the wagering game object so that the object can self-manage its own actions and responses in response to events within the wagering game, such as by using behavior trees. The wagering game server 250 also can include a simulations manager 256 configured to control simulations of a wagering game, sort, filter, and/or store the simulations into groupings, and use the simulations from the groupings in subsequent wagering games to animate a wagering game result. The simulations manager can work with self-managing, intelligent behavior controllers, such as behavior trees, to control behaviors within the wagering game.

The wagering game system architecture 200 also can include a wagering game machine 260 configured to present wagering games and receive and transmit information to control event-driven behavior of wagering game objects. The wagering game machine 260 can include a content controller 261 configured to manage and control content and presentation of content on the wagering game machine 260. The wagering game machine 260 also can include a content store 262 configured to contain content to present on the wagering game machine 260. The wagering game machine 260 also can include an event detector 263 configured to determine events that occur within a wagering game and report the events to the behavior controller unit 255, in the wagering game server 250. The behavior controller unit 255 can then generate behavior control information for wagering game objects and send the behavior control information to the wagering game machine 260, which the wagering game machine 260 can use to control the wagering game objects' responses to the events.

Each component shown in the wagering game system architecture 200 is shown as a separate and distinct element. However, some functions performed by one component could be performed by other components. For example, the server 250 can detect events that occur within a wagering game. Furthermore, the components shown may all be contained in one device, but some, or all, may be included in, or performed by multiple devices on the systems and networks 222, as in the configurations shown in FIG. 2 or other configurations not shown. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
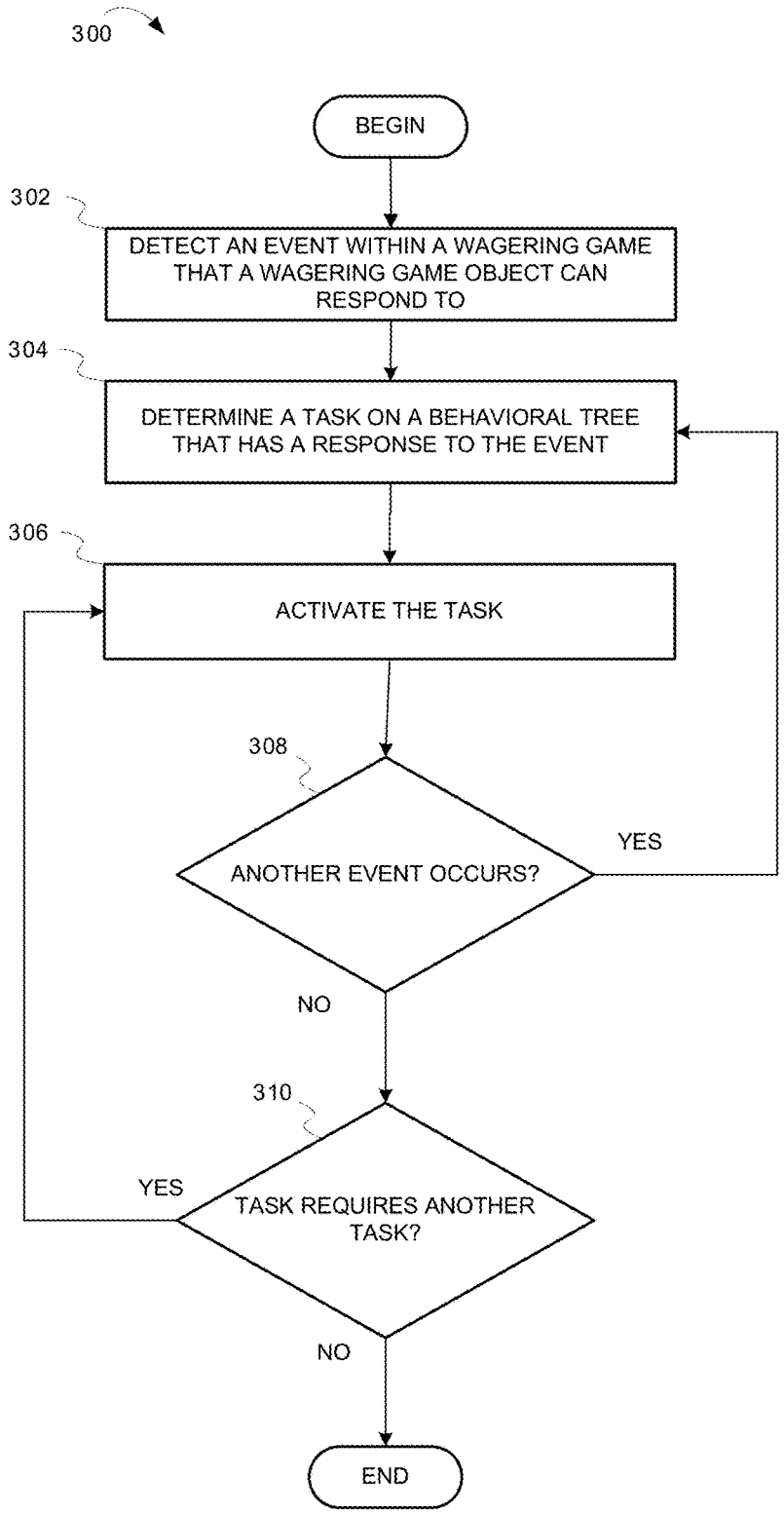
FIG. 3 is a flow diagram 300 illustrating controlling wagering game objects using event-driven behavior controllers, according to some embodiments.

FIG. 3 is a flow diagram illustrating controlling wagering game objects using event-driven behavior controllers, according to some embodiments. In FIG. 3, the flow 300 begins at processing block 302, where a wagering game system ("system") detects an event within a wagering game that a wagering game object can respond to. For example, FIG. 1 illustrated examples of detecting events in a wagering game. In FIG. 1, the system 100 (e.g., the wagering game machine 162, the wagering game server 150, etc.) can include behavior controllers (e.g., a behavior tree 103, a system agent, an event detector, etc.) that detect the events. The system components (e.g., the wagering game machine 162, the wagering game server 150, etc.) can generate the events while presenting a wagering game. For example, a wagering game server can generate control events, wagering game result events, etc. The behavior controller can detect the events. The behavior controller can also generate additional events when processing responses.

The flow 300 continues at processing block 304, where the system determines a task on a behavior tree that has a response to the event. In some embodiments, many events may occur simultaneously. A wagering game object within the wagering game may detect the simultaneous events and need to respond to the simultaneous events. The system, therefore, may determine multiple behavioral tasks to process simultaneously. If the system detects simultaneous events that pertain to the same wagering game object, then the system can determine the priority of the events and process the tasks according to the priority. In determining the priority of the events, the system can consider various factors, such as the timing of the events, the severity of the events' impact on the wagering game object, possible interactions between the wagering game object and other objects, distances away from the wagering game object that the events occurs, the events' frequency of occurrence, a requirement to complete a wagering game outcome or goal within a specific time period, etc. To determine the priority of the events, the system can refer to event priority charts, refer to past scenarios involving the same events, run quick simulations showing possible object interactions, etc. One or more behavior trees may include the ability to determine priority of tasks. The system can then process the tasks according to the determined priority. For example, the system can process high priority tasks before processing low priority tasks. After processing high priority tasks, the system can re-evaluate low priority tasks to see if the lower priority events still need processing (e.g., the behavior tree(s) may process child tasks of the higher priority tasks, where the performance of the child tasks may eliminate the need to process the lower priority tasks). If there are conflicts between tasks, the system can resolve the conflicts by assigning priority scores, ranking the scores, then processing the tasks according to their priority score rankings.

The flow 300 continues at processing block 306, where the system activates (e.g., runs, executes, etc.) the task. The task causes the wagering game object to perform specific actions in response to the event. In some embodiments, the behavior tree includes a root node, which selects the particular task to run. A scheduler can execute the task, which in turn executes one or more child tasks, and so on, until completing the tasks. The behavior tree can then cause the wagering game object to function in an "idle" state in the absence of any events. A priority selector can prioritize and select tasks and sub-tasks.

The flow 300 continues at processing block 308, where the system determines whether a second event occurs during the performance of the first task's behavioral response. If another event does occur, the flow 300 can return to processing block 304 and determine another task that relates to the event. If there is a conflict between the performances of the two tasks, the system can prioritize, as mentioned previously. The same behavior tree can include tasks that cause the wagering game object to respond to the multiple events in the proper order. In some embodiments, the system can also utilize a second behavior tree to cause another object to respond to the subsequent event. For example, if the wagering object is at risk of being intercepted or interfered with, the second object can deter the interference. If, however, there are no additional events within the wagering game, the flow 300 can continue at processing block 310.

The flow 300 continues at processing block 310, where the system determines whether the first task requires one or more additional tasks to activate. For instance, a task can call additional tasks (e.g., sub-tasks, child-tasks, a task in another behavior tree, etc.). If there are any additional tasks, then the system can return to processing block 306 and activate the additional task(s). The system can prioritize and process the one or more additional tasks. If, however, there are no more tasks to execute, the flow 300 can end. The wagering game object can return to an idle state and await any additional events.

Figure 4:
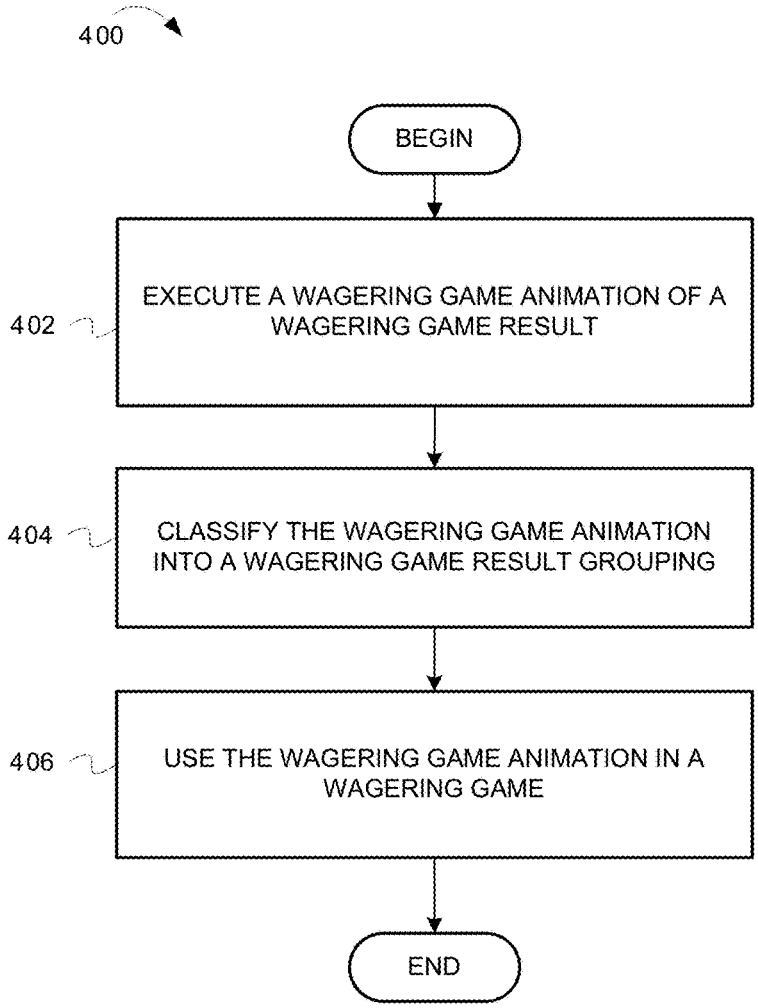
FIG. 4 is a flow diagram 400 illustrating storing and using groupings of event-driven wagering game animations, according to some embodiments.
Figure 5:
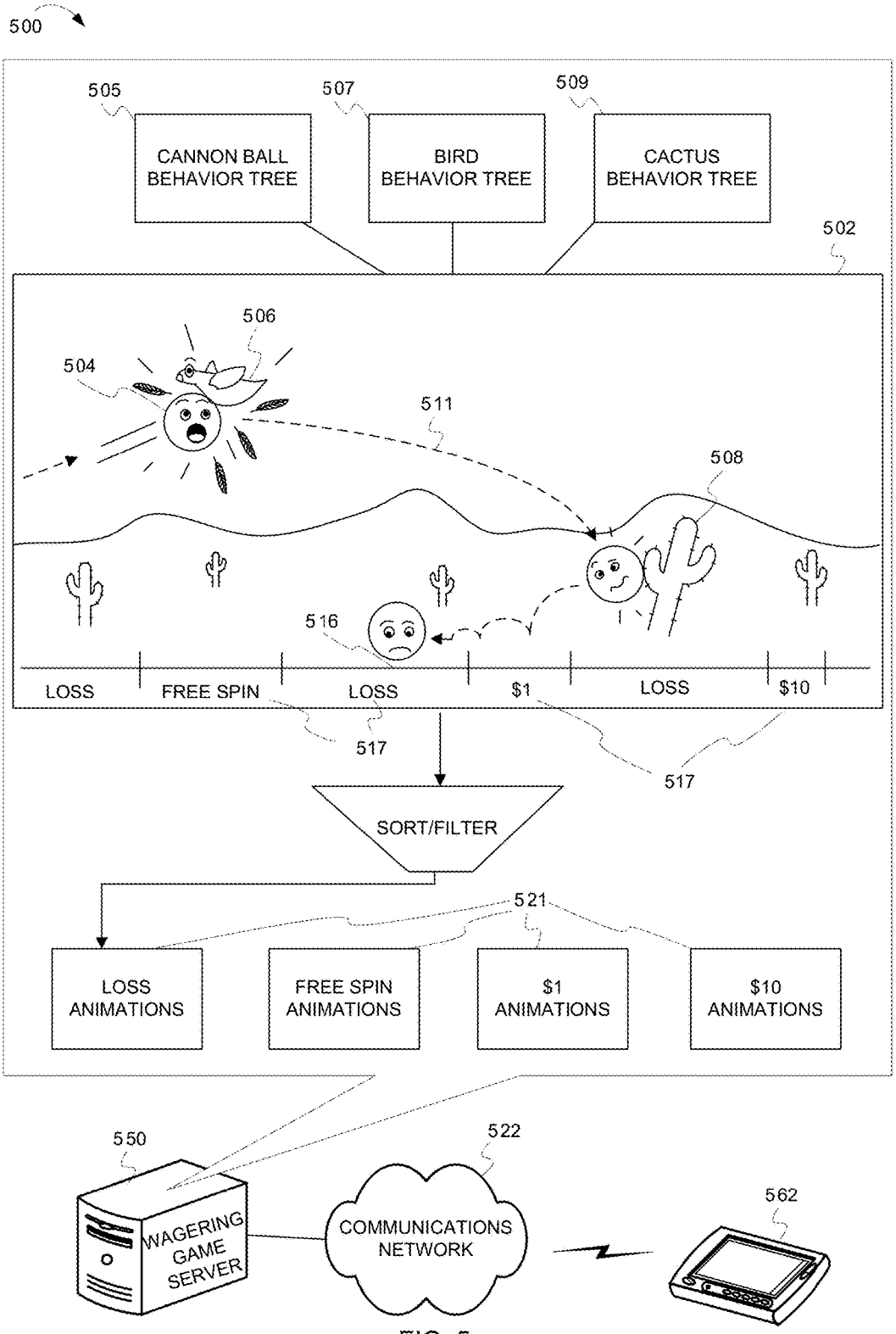
FIG. 5 is an illustration of a wagering game system 500, according to some embodiments.

FIG. 4 is a flow diagram illustrating storing and using groupings of event-driven wagering game animations, according to some embodiments. FIG. 5 is a conceptual diagram that helps illustrate the flow of FIG. 4, according to some embodiments. This description will present FIG. 4 in concert with FIG. 5. In FIG. 4, a flow 400 begins at processing block 402 where a wagering game system ("system") executes a wagering game animation of a wagering game result. The wagering game animation can feature a wagering game object that performs actions animating the events of the wagering game result. For example, in FIG. 5, the system 500 can generate a wagering game animation 502 featuring a cannon ball character ("cannon ball") 504. The canon ball 504 can interact with other objects (e.g., the bird 506, the cactus 508). In the wagering game animation 502, the system 500 can utilize behavior controllers, such as behavior trees 505, 507, 509, that are associated, respectively, with the canon ball 504, the bird 506 and the cactus 508. The canon ball 504 travels a path 511 to a final resting position 516 in a region that correlates to one of various wagering game result values 517. The wagering game result values 517 can be money payout values (e.g., money amounts, credits, etc.) that a wagering game player can receive for winning a wagering game. A payout value, however, is only one kind of wagering game result value. Other wagering game result values may include an award value that doesn't pay money (e.g., a new connection to a social contact, a social status increase, an invitation to a wagering game or tournament, etc.), a loss value, an activity to perform, etc.

The flow 400 continues at processing block 404, where the system classifies the wagering game animation into a wagering game result grouping. For example, in FIG. 5, the system 500 sorts and stores the wagering game animation 502 into different groupings 521 that correspond to the wagering game result values 517. In other words, if the canon ball 504 lands on a region that correlates to a "loss", then the system 500 stores the animation in the "Loss Animations" grouping. The system 500 can also filter the wagering game animation 502, and any subsequent wagering game animations, from the groupings 521. For instance, if some wagering game animations within the groupings 521 are less exciting (e.g., less dynamic, too slow, very few object interactions, etc.), the system 500 can filter them out. The system 500 can filter the groupings 521 based on different factors that relate to the dynamics of the animations (e.g., a number of interactions the cannon ball 504 has with other objects, a duration the cannon ball 504 is in motion, a number of bounces or changes of direction by the cannon ball 504, a negative or "backward" distance the cannon ball 504 travels, specific types of object the cannon ball 504 hits, a number of tasks processed by the behavior trees 505, 507, 509, etc.). In some embodiments, the cannon ball 504, or other player characters, can interact with objects to induce additional games, activities, etc. For example, the cannon ball 504 may hit the bird 506, and system 500 can present a bonus game, a bonus prize, additional game play, tasks to perform, etc. The system 100 can add winnings from a bonus game or activity to winnings for the original game. In some embodiments, the additional activities may affect the original game's wagering game result value (e.g., the additional activity adds thrust to the cannon ball 504 to alter the trajectory of the cannon ball 504, the additional activity moves the final resting position 516 of the cannon ball 504, etc.). In some embodiments, the groupings 521 that correspond to the wagering game result values 517 can be related to objectives achieved by the player's game character other than, or in addition to, a final resting position. For example, a wagering game's payout value may be tied to a number of items with which a wagering game character interacts (e.g., a number of items the wagering game character collects, hits, etc.). Thus, the groupings 521 can be based on the number of interactions that the wagering game character experiences during the wagering game.

The flow 400 continues at processing block 406, where the system uses the wagering game animation in a wagering game. For example, in FIG. 5, the wagering game server 550 can generate, sort, filter, and store the animation 502 before the wagering game machine 562 runs the animation during a wagering game. During the wagering game, the wagering game server 550 can generate a random wagering game result (e.g., a win), resulting in a payout value (e.g., $10). The system 500 can then select an animation from one of the groupings 521 that correlates to the payout value (e.g., select, from the "$10 Animations" grouping, an animation of the player objects obtaining a $10 payout). The wagering game machine 562 can then present the selected animation, demonstrating the wagering game outcome. In other embodiments, however, the wagering game machine 562 can generate the animation 502 during a wagering game and the wagering game server 550 can sort, filter, and store it for future use in other wagering games.

Figure 6:
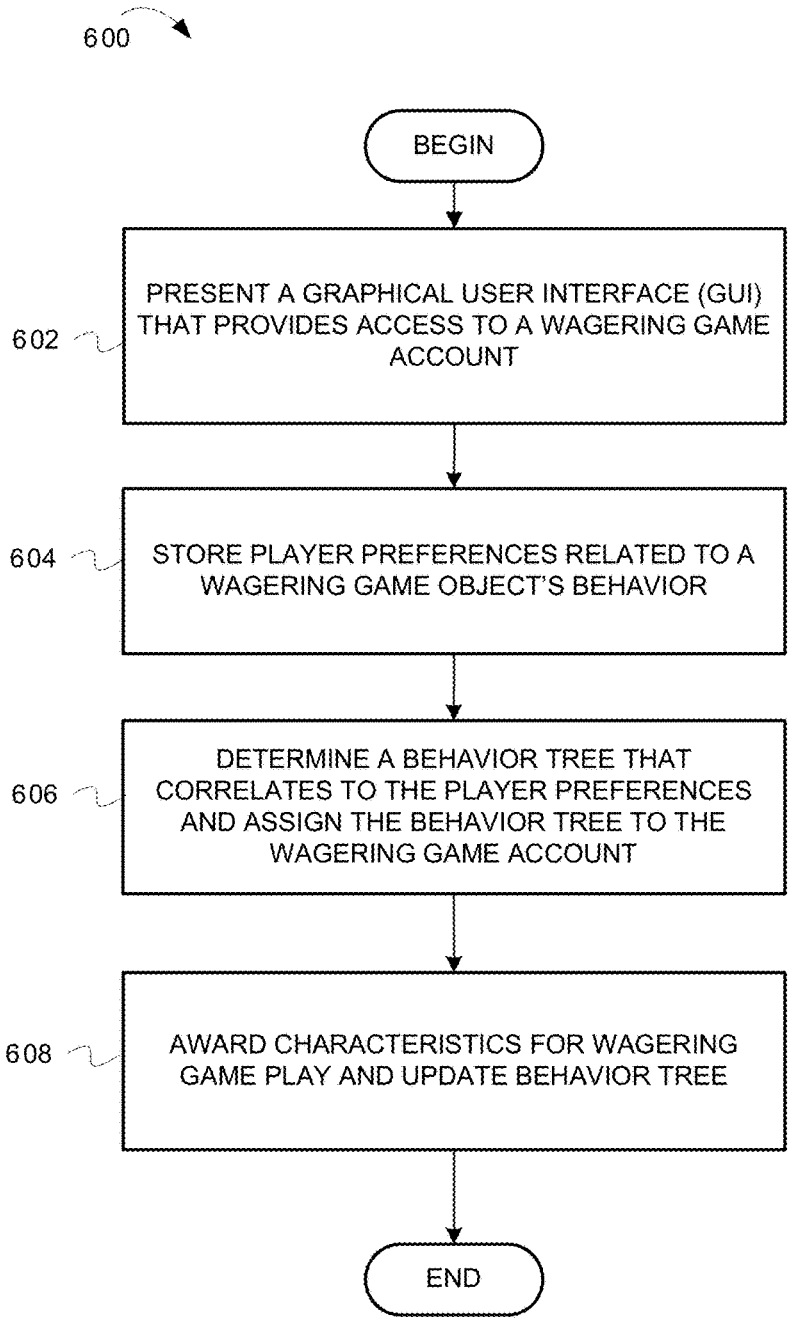
FIG. 6 is a flow diagram 600 illustrating managing preferred wagering game player object behaviors, according to some embodiments.
Figure 7:
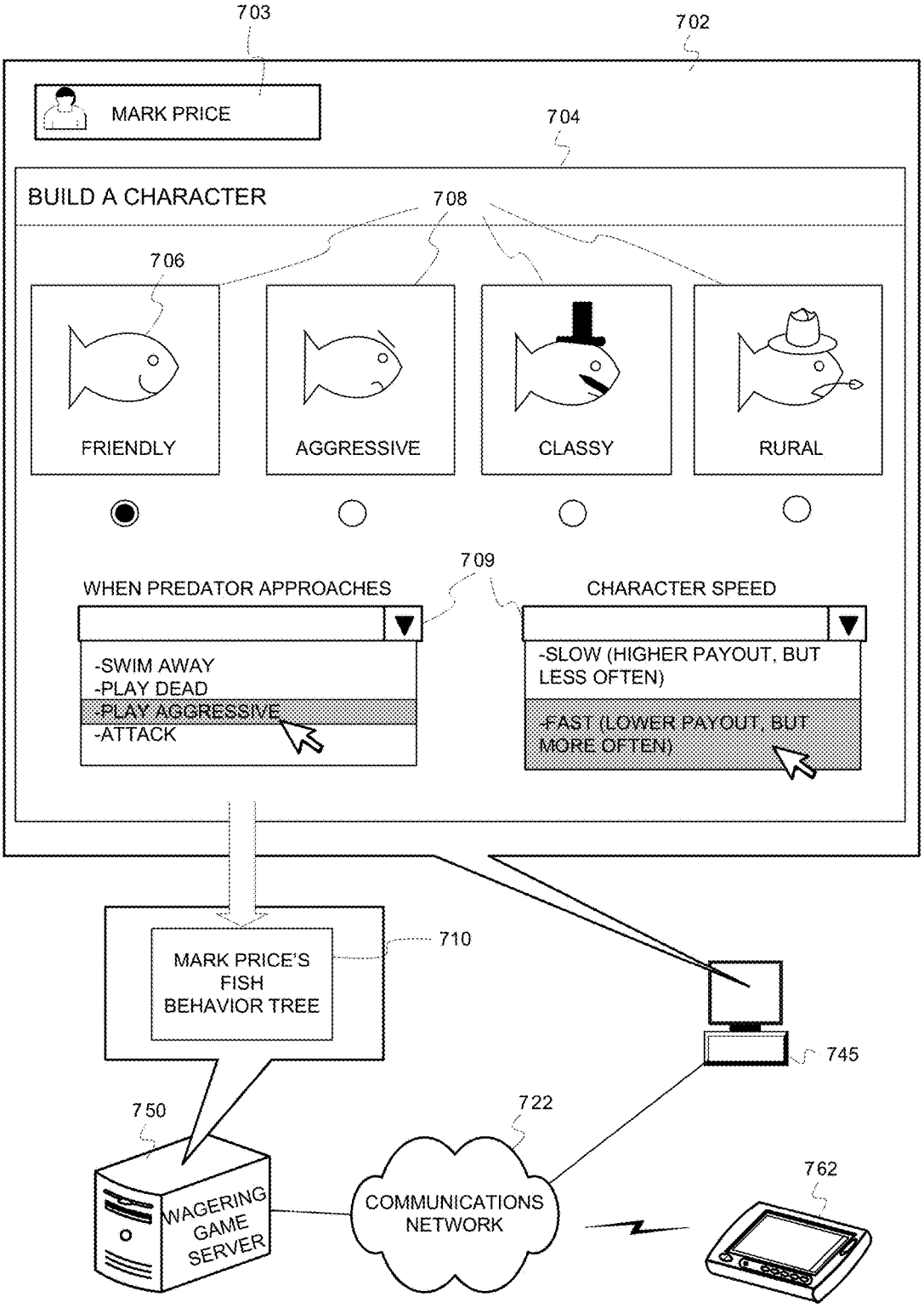
FIG. 7 is an illustration of a wagering game system 700, according to some embodiments.

FIG. 6 is a flow diagram illustrating managing preferred wagering game player object behaviors, according to some embodiments. FIG. 7 is a conceptual diagram that helps illustrate the flow of FIG. 6, according to some embodiments. This description will present FIG. 6 in concert with FIG. 7. In FIG. 6, a flow 600 begins at processing block 602, where a wagering game system ("system") presents a graphical user interface (GUI) that provides access to a wagering game account. For example, in FIG. 7, a computer 745 presents a GUI 702. The GUI 702 provides access to a wagering game account 703. The wagering game account 703 can belong to a wagering game player (e.g., Mark Price). The wagering game player ("player") can access the wagering game account 703 from the computer 745 (e.g., a home computer, a personal digital assistant, a mobile device, etc.), while away from the casino network. While within the casino network, the player can access the wagering game account either on the computer 745, a wagering game machine 762, a casino terminal or kiosk, etc. The wagering game account 703 can be stored on a wagering game server 750 (and/or on other servers not shown, like an account server) accessible via a communications network 722.

Returning now to FIG. 6, the flow 600 continues at processing block 604, where the system stores player preferences in the wagering game account related to a wagering game object's behavior. The player preferences have settings that are related to behaviors a wagering game object can perform during a wagering game. The wagering game object can be a game object that represents the player (i.e., a "player" object, like the canon ball 504 in FIG. 5, or the fish 106 in FIG. 1), and/or that the player can control, during the wagering game. For example, in FIG. 7, the GUI 702 includes a panel 704 with various settings related to a wagering game character 706 (e.g., a fish avatar). The wagering game character ("character") 706 can have certain personality traits, or characteristics, that dictate how the character 706 will respond to events during a wagering game. The panel 704 can present characteristic settings 708, that the player can select. The characteristic settings 708 may not necessarily indicate specific actions that the character 706 will perform during the wagering game, but may instead present settings related to the general characteristics of the character. The settings can be in the form of general moods (e.g., grumpy, happy aggressive), personality types (e.g., outgoing, shy, nerdy), character types (e.g., a fish, a robot, a warrior), professions (e.g., lawyer, engineer, construction worker), etc. The system 700 can determine the specific actions that the character can perform based on the characteristic settings 708. On the other hand, the system 700 can also present action settings 709, which convey specific events that may occur within a wagering game, as well as specific reactions that the character 706 can have to the events. The system 700 can use the action settings 709 to perform specific actions during the wagering game. For example, the system 700 can present action settings 709 that control the speed of the character 706. The system 700 can use the action to also affect the payout of the wagering game. For instance, if the player preference is for a slower moving character 706, the system 700 may adjust wagering game payouts to be fewer in frequency, but higher in payout value.

Returning again to FIG. 6, the flow 600 continues at processing block 606, where the system determines a behavior tree that correlates to the player preferences, and assigns the behavior tree to the wagering game account. The system can determine the behavior tree by generating the behavior tree based on the settings, or by selecting a pre-existing behavior tree that matches the settings. The system then associates the behavior tree with the wagering game account so that when the player logs in to a wagering game session, the system can use the behavior tree during the wagering game session to control the player's character(s). In some embodiments, the system can also store the settings into a configuration file that the system can use to generate the behaviors or to create the behavior tree. The player can store the configuration file, such as on a player identification card, and upload it to a wagering game server before a wagering game session. The wagering game server can then construct a behavior tree for the player's character, even if the wagering game server cannot access the player's account. In FIG. 7, the system 700 generates the behavior tree 710 from the player preference settings and stores the behavior tree 710 on the wagering game server 750.

The flow 600 continues, at processing block 608, where the system awards characteristics as a reward for wagering game play, and updates the behavior tree. For example, the system can award abilities (e.g., super speed), appearances (e.g., clothing, facial expressions), items (e.g., sunglasses, a metal detector, etc.) and so forth. The system can award the characteristics based on various factors, such as how much money a player has spent on a wagering game, what level a player has attained on a wagering game, a specific number of wagering game events, etc. The system can automatically assign the characteristics to the wagering game character by adding new branches to the behavior tree and/or enabling access to parts of the behavior tree that previously weren't available. In some embodiments, the system can instead present the obtained characteristics to the player via the graphical user interface (e.g., GUI 702 in FIG. 7). The player can then select which abilities the player prefers. The system can then update the behavior tree (e.g., behavior tree 710) with the newly selected characteristics.

Additional Example Embodiments

According to some embodiments, a wagering game system ("system") can provide various example devices, operations, etc., to control event-driven behavior of wagering game objects. The following non-exhaustive list enumerates some possible embodiments.

The system can monitor multiple events in a casino network. The system can use a network agent to track multiple events across wagering games, bonus games, progressive games, etc. using behavior controllers. The system can prevent wagering game objects from interfering excessively and can assist wagering game objects to obtain wagering game outcomes within specified time periods.

The system can monitor multiple behavior trees and coordinate behaviors.

The system can simulate responses by a plurality of wagering game objects, before the objects perform their behaviors. The system can analyze the simulations and assist behavior controllers to enact responses to events.

The system can generate non-player characters (e.g., "house-generated" fish) to cause anticipation, interference, etc. The system can control those non-player objects using behavior controllers. For instance, those non-player characters can move player characters along a path, direct it, etc.

The system can parameterize the behaviors in a behavior tree with time restraints. For example, the system can use reverse behaviors (with system generated artificial intelligence) to generate motives, (e.g., system controlled shark to chase a fish to make the fish's behavior more believable, a system controlled crab to push a ball around with bubbles, etc.) In other words, the system can change the environment with computer characters to control behavior. The system can also use agents with certain objects to add control properties to the wagering game.

The system can use a behavior controller (e.g., a behavior tree decorator) to check non-volatile random access memory (NVRAM), force a state, etc.

The system can be managed with a tool that can draw a behavior tree and generate the behavior tree with the tool instead of scripting the behavior tree.

The system can determine multiple points of contact, fluid dragging/swiping and some 3D capabilities including some forms of physics representation. The multiple points of contact, fluid dragging, etc. may be integrated as inputs to behavior trees. For example, dragging a mouse, making hand gestures on a screen, etc., may be used to generate specific types of movements that a character can make. The system can capture the hand movements and add the corresponding movements into the character's behavior tree. For example, in FIG. 7, the panel 704 may include a "character training" section, where the player can train the character to perform certain behaviors.

The system can present a team challenge game where players direct their characters (e.g., fish) via hand gestures. Players of a team work together to win by directing their characters to block other team's characters and to achieve game objectives (e.g., eat coins). In some embodiments, the system can capture strategic movements or patterns of movement made by a player's hand movements, during the game, and add them to their character's behavior tree as a learned behavior. In some embodiments, the hand gestures can alter a character's behavior during the wagering game, such as by stroking a character to calm it down, thus causing the system to utilize a portion of the behavior tree that relates to calm behavior.

The system can present an antagonistic object (e.g., like a "hot potato") that purposefully interferes with a wagering game and/or affects the outcome of the game. The system can present the antagonistic object in a group game scenario and the wagering game player can force the object onto another player's playing surface to avoid the object's interaction. The antagonistic object can lay dormant, and activate at random, causing a player to lose. The player's interaction with the antagonistic object, and the antagonistic object's reaction, can be manipulated by behavior controllers. During the game, player's can attempt to achieve other goals, like play a hand of cards (e.g., blackjack), spin a reel, etc. The system can utilize achieved goals to generate groupings of animations for further game play, such as the groupings 521 described in FIG. 5.

Additional Example Operating Environments

This section describes example operating environments, systems and networks, and presents structural aspects of some embodiments.

Wagering Game Machine Architecture

Figure 8:
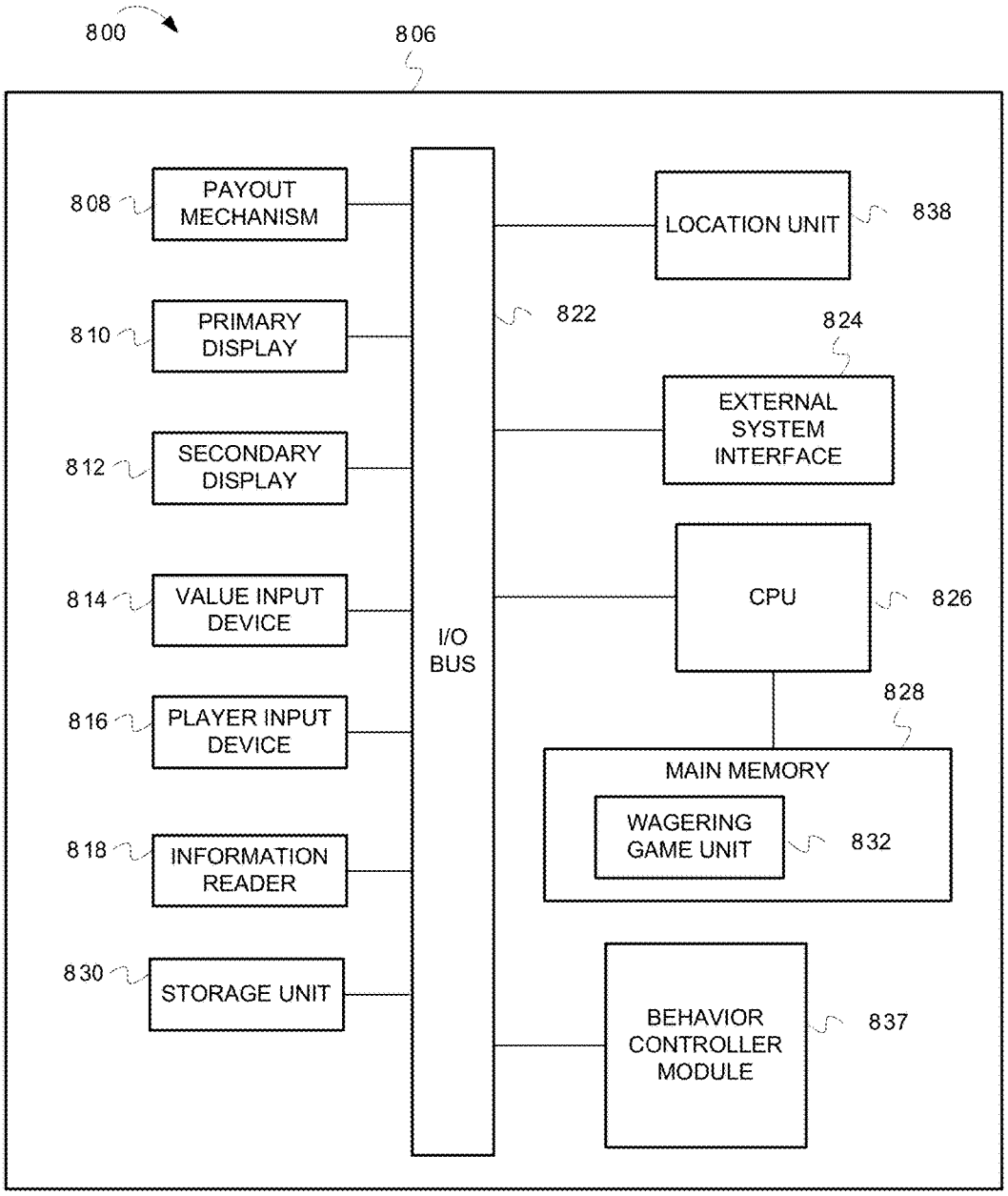
FIG. 8 is an illustration of a wagering game machine architecture 800, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems 804 (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a behavior controller module 837. The behavior controller module 837 can process communications, commands, or other information, where the processing can control event-driven behavior of wagering game objects.

Furthermore, any component of the wagering game machine 806 can include hardware, firmware, and/or machine-readable media including instructions for performing the operations described herein.

Mobile Wagering Game Machine

Figure 9:
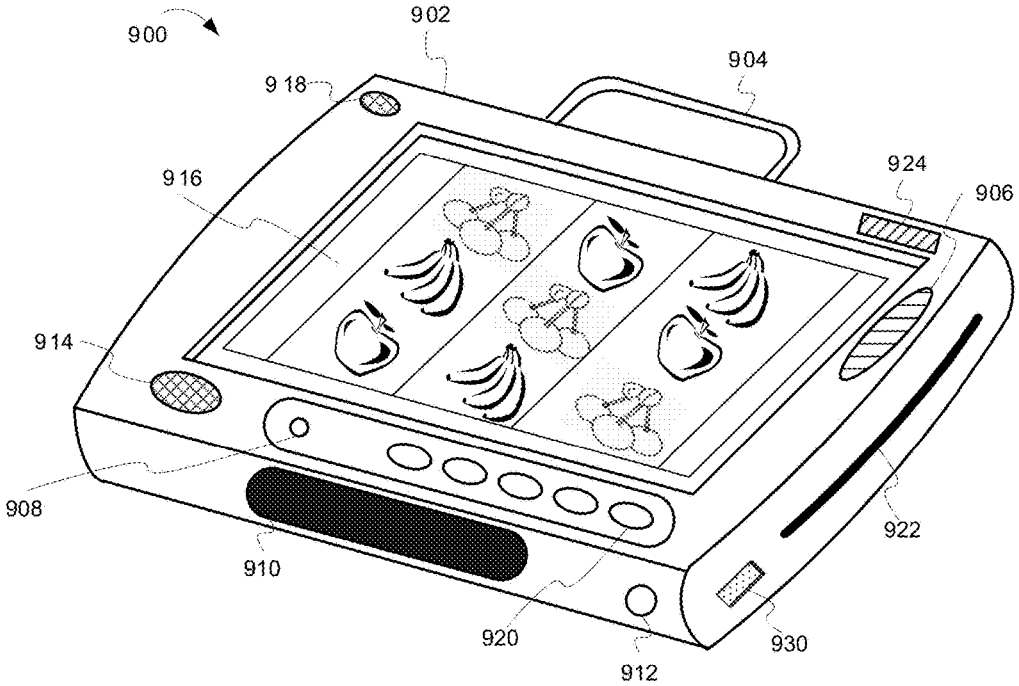
FIG. 9 is an illustration of a mobile wagering game machine 900, according to some embodiments.

FIG. 9 is a conceptual diagram that illustrates an example of a mobile wagering game machine 900, according to some embodiments. In FIG. 9, the mobile wagering game machine 900 includes a housing 902 for containing internal hardware and/or software such as that described above vis-á-vis FIG. 8. In some embodiments, the housing has a form factor similar to a tablet PC, while other embodiments have different form factors. For example, the mobile wagering game machine 900 can exhibit smaller form factors, similar to those associated with personal digital assistants. In some embodiments, a handle 904 is attached to the housing 902. Additionally, the housing can store a foldout stand 910, which can hold the mobile wagering game machine 900 upright or semi-upright on a table or other flat surface.

The mobile wagering game machine 900 includes several input/output devices. In particular, the mobile wagering game machine 900 includes buttons 920, audio jack 908, speaker 914, display 916, biometric device 906, wireless transmission devices 912 and 924, microphone 918, and card reader 922. Additionally, the mobile wagering game machine can include tilt, orientation, ambient light, or other environmental sensors.

In some embodiments, the mobile wagering game machine 900 uses the biometric device 906 for authenticating players, whereas it uses the display 916 and speakers 914 for presenting wagering game results and other information (e.g., credits, progressive jackpots, etc.) The mobile wagering game machine 900 can also present audio through the audio jack 908 or through a wireless link such as Bluetooth.

In some embodiments, the wireless communication unit 912 can include infrared wireless communications technology for receiving wagering game content while docked in a wager gaming station. The wireless communication unit 924 can include an 802.11G transceiver for connecting to and exchanging information with wireless access points. The wireless communication unit 924 can include a Bluetooth transceiver for exchanging information with other Bluetooth enabled devices.

In some embodiments, the mobile wagering game machine 900 is constructed from damage resistant materials, such as polymer plastics. Portions of the mobile wagering game machine 900 can be constructed from non-porous plastics which exhibit antimicrobial qualities. Also, the mobile wagering game machine 900 can be liquid resistant for easy cleaning and sanitization.

In some embodiments, the mobile wagering game machine 900 can also include an input/output ("I/O") port 930 for connecting directly to another device, such as to a peripheral device, a secondary mobile machine, etc. Furthermore, any component of the mobile wagering game machine 900 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system, said method comprising:

electronically determining, via an electronic gaming controller of the gaming system, an outcome to present for a wagering game, wherein the wagering game includes a wagering game object configured to present the outcome using a set of possible behavioral responses, and wherein the gaming system comprises a value input device configured to receive monetary value for placement of wagers in the wagering game;

based on the outcome, automatically determining, via the electronic gaming controller, priorities for the set of possible behavioral responses, wherein the automatically determining the priorities for the set of possible behavioral responses comprises one or more of electronically analyzing virtual physics that govern interactions between the wagering game object and other objects, electronically analyzing a distance the wagering game object is from one or more other objects associated with the outcome, and electronically analyzing a frequency of occurrence of the outcome;

automatically performing, via the electronic gaming controller, at least a portion of the set of possible behavioral responses according to the priorities; and causing the wagering game object to present the outcome for the wagering game in response to the automatically performing the at least the portion of the set of possible behavioral responses.

2. The method of claim 1, wherein the set of possible behavioral responses are included in a behavior tree associated with the wagering game object.

3. The method of claim 1, wherein the determining the priorities for the set of possible behavioral responses comprises automatically determining a requirement for the wagering game object to present the outcome within a given number of interactions between the wagering game object and one or more additional objects presented with the wagering game object in the wagering game.

4. The method of claim 3 further comprising:

automatically selecting, based on the requirement, a behavior tree for the wagering game object; and after electronically determining the outcome, automatically associating the behavior tree with the wagering game object, wherein the behavior tree includes the at least the portion of the set of possible behavioral responses that would cause the wagering game object to present the outcome within the given number of interactions.

5. The method of claim 3 further comprising:

automatically selecting, based on the requirement, one or more behavior trees for the one or more additional wagering game objects; and after electronically determining the outcome, associating the one or more behavior trees with the one or more additional wagering game objects, wherein the one or more behavior trees limit behavioral responses from the one or more additional wagering game objects to the given number of interactions with the wagering game object.

6. The method of claim 1, wherein the automatically determining the priorities for the set of possible behavioral responses comprises automatically determining a requirement to display the outcome within a specific time period.

7. The method of claim 1 further comprising:

automatically determining, based on the outcome, that a first behavioral response, from the set of possible behavioral responses, conflicts with a second behavioral response, from the set of possible behavioral responses; and prioritizing, via the electronic gaming controller, presentation of the first behavioral response above the second behavioral response to prevent a conflict with the second behavioral response.

8. The method of claim 7 further comprising:

determining a schedule for processing the first behavioral response and the second behavioral response; and processing, via the electronic gaming controller, behavior tree tasks in the wagering game according to the schedule to prevent the conflict between the first behavioral response and the second behavioral response.

9. One or more non-transitory, machine-readable storage media having instructions stored thereon, which, when executed by a set of one or more processors of a gaming system, cause the set of one or more processors to perform operations comprising:

electronically determining an outcome to present for a wagering game, wherein the wagering game includes a wagering game object configured to present the outcome using a set of possible behavioral responses, wherein the gaming system comprises a value input device configured to receive monetary value for placement of wagers in the wagering game;

based on the outcome, automatically determining priorities for the set of possible behavioral responses, wherein the priorities are for a requirement for the wagering game object to present the outcome within a given number of interactions between the wagering game object and one or more additional objects presented with the wagering game object in the wagering game;

automatically performing at least a portion of the set of possible behavioral responses according to the priorities; and causing the wagering game object to present the outcome for the wagering game in response to the automatically performing the at least the portion of the set of possible behavioral responses.

10. The one or more non-transitory, machine-readable storage media of claim 9, wherein the set of possible behavioral responses are included in a behavior tree associated with the wagering game object.

11. The one or more non-transitory, machine-readable storage media of claim 9, said operations further comprising:

selecting, based on the requirement, a behavior tree for the wagering game object; and after determining the outcome, associating the behavior tree with the wagering game object, wherein the behavior tree includes the at least the portion of the set of possible behavioral responses that would cause the wagering game object to present the outcome within the given number of interactions.

12. The one or more non-transitory, machine-readable storage media of claim 9, said operations further comprising:

selecting, based on the requirement, one or more behavior trees for the one or more additional objects; and after determining the outcome, associating the one or more behavior trees with the one or more additional objects, wherein the one or more behavior trees limits behavioral responses from the one or more additional objects to the given number of interactions with the wagering game object.

13. A gaming system comprising:

one or more electronic processing units;

a value input device configured to receive monetary value for placement of wagers in a wagering game; and one or more memory storage devices configured to store instructions, which when executed by at least one of the one or more electronic processing units, cause the gaming system to perform operations to, electronically determine an outcome to present for the wagering game, wherein the wagering game includes a wagering game object configured to present the outcome based on a set of possible behavioral responses, based on the outcome, automatically determine priorities for the set of possible behavioral responses, automatically perform at least a portion of the set of possible behavioral responses according to the priorities, cause the wagering game object to present the outcome for the wagering game in response to performance of the at least the portion of the set of possible behavioral responses, determine, based on the outcome, that a first behavioral response, from the set of possible behavioral responses, conflicts with a second behavioral response, from the set of possible behavioral responses, and prioritize presentation of the first behavioral response above the second behavioral response to prevent a conflict with the second behavioral response.

14. The gaming system of claim 13, wherein the one or more memory storage devices configured to store the instructions, which when executed by the at least one of the one or more electronic processing units, cause the gaming system to perform the operation to automatically determine the set of possible behavioral responses are configured to store instructions, which when executed by at least one of the one or more electronic processing units, cause the gaming system to perform one or more operations to one or more of analyze virtual physics that govern interactions between the wagering game object and other objects, analyze a distance the wagering game object is from one or more other objects associated with the outcome, and analyze a frequency of occurrence of the outcome.

15. The gaming system of claim 13, wherein the one or more memory storage devices configured to store the instructions, which when executed by the at least one of the one or more electronic processing units, cause the gaming system to perform the operation to automatically determine the priorities for the set of possible behavioral responses are configured to store the instructions, which when executed by at least one of the one or more electronic processing units, cause the gaming system to perform one or more operations to determine a requirement to display the outcome within a specific time period.

16. The gaming system of claim 13, wherein the one or more memory storage devices are configured to store instructions, which when executed by at least one of the one or more electronic processing units, cause the gaming system to further perform operations to:

determine a schedule for processing the first behavioral response and the second behavioral response; and process behavior tree tasks in the wagering game according to the schedule to prevent the conflict between the first behavioral response and the second behavioral response.

17. The method of claim 2 further comprising:

detecting a player setting that indicates a preferred characteristic for the wagering game object;

determining, via the electronic gaming controller, that the behavior tree specifies a behavior that corresponds to the preferred characteristic in response to evaluating the preferred characteristic against behaviors specified in the behavior tree; and associating, via the electronic gaming controller, the behavior tree with the wagering game object, wherein the behavior tree causes the wagering game object to exhibit, during a wagering game, behavior that corresponds to the preferred characteristic.

18. The method of claim 17, wherein the behavior tree governs behavioral responses by the wagering game object to one or more of wagering game events of the wagering game and interactions with one or more wagering game objects of the wagering game.

19. The method of claim 17, wherein the behavior tree affects one or more of a payout frequency and a payout value of the wagering game.

20. The method of claim 17 further comprising:

presenting a graphical user interface configured to receive player input regarding one or more of wagering game object behaviors, personality types of a wagering game character, possible events that occur during the wagering game, and potential responses to events that occur during the wagering game.

21. The method of claim 17, further comprising generating the behavior tree to respond to events in the wagering game according to the preferred characteristic.

22. The method of claim 17, further comprising selecting one behavior tree from a plurality of behavior trees, wherein the behavior tree is configured to respond to events in the wagering game according to the preferred characteristic.

23. The method of claim 17, wherein the detecting the player setting that indicates the preferred characteristic for the wagering game object comprises reading the player setting from one or more of a player account and a player identification card.

24. The method of claim 17 further comprising:

awarding an additional characteristic for the wagering game object based on wagering game play; and modifying the behavior tree to exhibit a behavior that corresponds to the additional characteristic.

25. A gaming system comprising:

one or more electronic processing units;

a value input device configured to receive monetary value for placement of wagers in a wagering game; and one or more memory storage devices configured to store instructions, which when executed by at least one of the one or more electronic processing units, cause the gaming system to perform operations to, electronically determine an outcome to present for the wagering game, wherein the wagering game includes a wagering game object configured to present the outcome using a set of possible behavioral responses, based on the outcome, automatically determine priorities for the set of possible behavioral responses, wherein the priorities are for a requirement to display the outcome within a specific time period, automatically perform at least a portion of the set of possible behavioral responses according to the priorities, and cause the wagering game object to present the outcome for the wagering game in response to the at least the portion of the set of possible behavioral responses.

26. A method of operating a gaming system comprising:

electronically determining an outcome to present for a wagering game, wherein the wagering game includes a wagering game object configured to present the outcome using a set of possible behavioral responses, and wherein the gaming system comprises a value input device configured to receive monetary value for placement of wagers in the wagering game, based on the outcome, automatically determining priorities for the set of possible behavioral responses, wherein the priorities are for a requirement to display the outcome within a specific time period, automatically performing at least a portion of the set of possible behavioral responses according to the priorities, and causing the wagering game object to present the outcome for the wagering game in response to the at least the portion of the set of possible behavioral responses.

27. One or more non-transitory, machine-readable storage media having instructions stored thereon, which, when executed by a set of one or more processors of a gaming system, cause the set of one or more processors to perform operations comprising:

electronically determining, via an electronic gaming controller of the gaming system, an outcome to present for a wagering game, wherein the wagering game includes a wagering game object configured to present the outcome using a set of possible behavioral responses, and wherein the gaming system comprises a value input device configured to receive monetary value for placement of wagers in the wagering game;

based on the outcome, automatically determining, via the electronic gaming controller, priorities for the set of possible behavioral responses;

automatically performing, via the electronic gaming controller, at least a portion of the set of possible behavioral responses according to the priorities;

causing the wagering game object to present the outcome for the wagering game in response to the automatically performing the at least the portion of the set of possible behavioral responses;

automatically determining, based on the outcome, that a first behavioral response, from the set of possible behavioral responses, conflicts with a second behavioral response, from the set of possible behavioral responses; and prioritizing presentation of the first behavioral response above the second behavioral response to prevent a conflict with the second behavioral response.

28. A gaming system comprising:

one or more electronic processing units;

a value input device configured to receive monetary value for placement of wagers in a wagering game; and one or more memory storage devices configured to store instructions, which when executed by at least one of the one or more electronic processing units, cause the gaming system to perform operations to, electronically determine an outcome to present for a wagering game, wherein the wagering game includes a wagering game object configured to present the outcome using a set of possible behavioral responses, based on the outcome, automatically determine priorities for the set of possible behavioral responses, based on one or more of virtual physics that govern interactions between the wagering game object and other objects, a distance the wagering game object is from one or more other objects associated with the outcome, and a frequency of occurrence of the outcome, automatically perform at least a portion of the set of possible behavioral responses according to the priorities, and cause the wagering game object to present the outcome for the wagering game after performance of the at least the portion of the set of possible behavioral responses.

* * * * *